US007397188B2

(12) United States Patent
Hong et al.

(10) Patent No.: US 7,397,188 B2
(45) Date of Patent: Jul. 8, 2008

(54) PLASMA DISPLAY PANEL

(75) Inventors: Chong-Gi Hong, Suwon-si (KR); Tae-Kyoung Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 513 days.

(21) Appl. No.: 11/213,926

(22) Filed: Aug. 30, 2005

(65) Prior Publication Data

US 2006/0091802 A1 May 4, 2006

(30) Foreign Application Priority Data

Nov. 4, 2004 (KR) ..... 10-2004-0089226

(51) Int. Cl.
*H01J 17/49* (2006.01)

(52) U.S. Cl. ..... 313/583; 313/584

(58) Field of Classification Search ..... 313/493, 313/634, 238, 292, 582–587
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,465,956 | B1 * | 10/2002 | Koshio et al. ..... 313/586 |

(Continued)

FOREIGN PATENT DOCUMENTS

JP 2845183 10/1998

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Peter Macchiarolo
(74) *Attorney, Agent, or Firm*—Robert E. Bushnell, Esq.

(57) ABSTRACT

A plasma display panel includes: an upper substrate; an upper dielectric layer formed on a lower surface of the upper substrate; sustain electrodes disposed in the upper dielectric layer; a lower substrate facing the upper substrate; a lower dielectric layer formed on an upper surface of the lower substrate; address electrodes formed in the lower dielectric layer so as to cross the sustain electrodes; main barrier ribs disposed on the lower dielectric layer so as to define discharge cells corresponding to regions where the sustain electrodes and the address electrodes cross each other; a phosphor layer formed in the discharge cells; and dummy barrier ribs disposed at an outermost portion of the main barrier ribs, and including respective dummy units which protrude from the main barrier ribs toward an outer portion, and which are connected to each other. The connection portions between the dummy units are disposed so as to overlap with at least one of terminal units of the sustain electrodes and terminal units of the address electrodes.

14 Claims, 4 Drawing Sheets

U.S. PATENT DOCUMENTS

| | | | | |
|---|---|---|---|---|
| 6,630,916 | B1 | 10/2003 | Shinoda | |
| 6,707,436 | B2 | 3/2004 | Setoguchi et al. | |
| 6,977,467 | B2 * | 12/2005 | Kawanishi | 313/582 |
| 7,015,645 | B2 * | 3/2006 | Kim et al. | 313/292 |
| 7,126,264 | B2 * | 10/2006 | Kawanishi | 313/582 |
| 7,154,222 | B2 * | 12/2006 | Woo et al. | 313/582 |
| 2004/0046505 | A1 * | 3/2004 | Kawanishi | 313/586 |
| 2004/0201351 | A1 * | 10/2004 | Woo et al. | 313/582 |
| 2006/0082304 | A1 * | 4/2006 | Song | 313/582 |
| 2006/0125396 | A1 * | 6/2006 | Han et al. | 313/582 |
| 2006/0202619 | A1 * | 9/2006 | Kim | 313/582 |

FOREIGN PATENT DOCUMENTS

| | | |
|---|---|---|
| JP | 2917279 | 4/1999 |
| JP | 2001-043804 | 2/2001 |
| JP | 2001-325888 | 11/2001 |
| KR | 10-2004-0023771 | 3/2004 |

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on Nov. 4, 2004 and there duly assigned Serial No. 10-2004-0089226.

BACKGROUND OF THE INVENTION

1. Technical Field

The present invention relates to a plasma display panel, and more particularly, to a plasma display panel having a structure capable of reducing noise by reducing a gap between a dielectric layer and barrier ribs.

2. Related Art

The plasma display panel recently replaced the cathode ray tube (CRT), and is a device for displaying images, in which a discharge gas is inserted between two substrates having a plurality of electrodes, a discharge voltage is applied to the panel to generate ultraviolet rays, and a phosphor layer of a predetermined pattern is excited by the ultraviolet rays so as to display an image.

The plasma display panel can be classified into a direct current (DC) type and an alternating current (AC) type. In the DC type plasma display panel, electrodes are exposed in a discharge space, and therefore electric charge moves directly between corresponding electrodes. In the AC type plasma display panel, electrodes of at least one side are covered by a dielectric layer, and thus a discharge is performed by movement of wall charge accumulated on the dielectric layer.

Since the charge directly moves between the corresponding electrodes in the DC type plasma display panel, the electrodes are severely damaged. Thus, an AC type plasma display panel having a three-electrode surface discharge type structure has been recently adopted.

In general, the AC plasma display panel includes an upper substrate displaying images, and a lower substrate facing the upper substrate, the two substrates being in parallel with each other. Sustain electrode pairs are formed on a lower surface of the upper substrate, and the sustain electrode pairs are embedded in an upper dielectric layer. In addition, address electrodes are formed on an upper surface of the lower substrate so as to cross the sustain electrode pairs, and the address electrodes are embedded in a lower dielectric layer. Barrier ribs defining discharge cells are formed between the lower dielectric layer and the upper dielectric layer. A discharge gas is inserted into the discharge cells, and red, green and blue color phosphor layers are selectively formed in the discharge cells for realizing colors.

In the plasma display panel described above, the barrier ribs are fabricated in predetermined patterns, and after that, they are baked. Then, after performing the latter processes, end portions of the barrier ribs become higher than center portions thereof due to extraction generated as a result of some components of the barrier ribs coming out during the processes. When the end portions of the barrier ribs become higher, detachment between the center portion of the barrier rib and the upper dielectric layer occurs. The detachment causes vibration noise during driving of the panel. Especially, the detachment becomes worse if terminal units of electrodes are drawn to edges of the substrates through the barrier ribs, the end portion of which become higher, in a state where the thickness of the dielectric layer is not uniform since the dielectric layer covers the electrodes.

SUMMARY OF THE INVENTION

The present invention provides a plasma display panel capable of minimizing detachment between a dielectric layer and dummy barrier ribs, and reducing vibration noise by disposing connection portions of dummy units formed on dummy barrier ribs that they overlap with terminal units drawn from electrodes.

According to an aspect of the present invention, there is provided a plasma display panel comprising: an upper substrate; an upper dielectric layer formed on a lower surface of the upper substrate; sustain electrodes disposed in the upper dielectric layer; a lower substrate facing the upper substrate; a lower dielectric layer formed on an upper surface of the lower substrate; address electrodes formed in the lower dielectric layer so as to cross the sustain electrodes; main barrier ribs disposed on the lower dielectric layer so as to define discharge cells corresponding to regions where the sustain electrodes and the address electrodes cross each other; a phosphor layer formed in the discharge cells; and dummy barrier ribs disposed at the outermost portion of the main barrier ribs, and including respective dummy units which protrude from the main barrier ribs toward an outer portion, and which are connected to each other. The connection portions between the dummy units are disposed so as to overlap with the terminal units of at least one of terminal units of the sustain electrodes and terminal units of the address electrodes.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
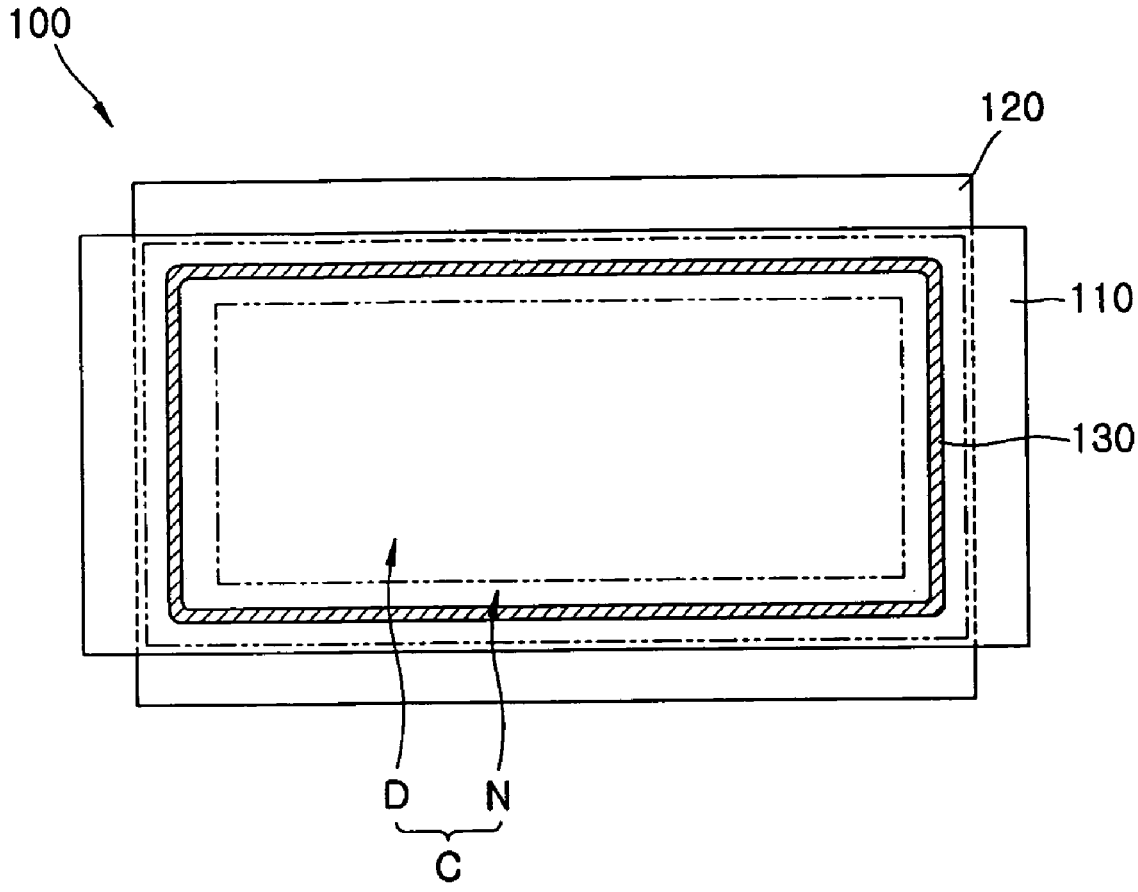
FIG. 1 is a plan view of a plasma display panel according to an embodiment of the present invention.

FIG. 1 is a plan view of a plasma display panel according to an embodiment of the present invention.

The plasma display panel 100 includes an upper panel 110 and a lower panel 120 coupled to the upper panel 110 and in parallel with the upper panel 110. A common area (C), where the upper panel 110 and the lower panel 120 overlap each other, can be divided into a display area (D) and a non-display area (N). The display area (D) is located at a center of the common area (C) so as to display images, and the non-display area (N) is located at edges of the common area (C) and does not display the image. In the non-display area (N), a sealing member 130, such as frit, is formed along the edges so as to couple and seal the upper panel 110 and lower panel 120.

Figure 2:
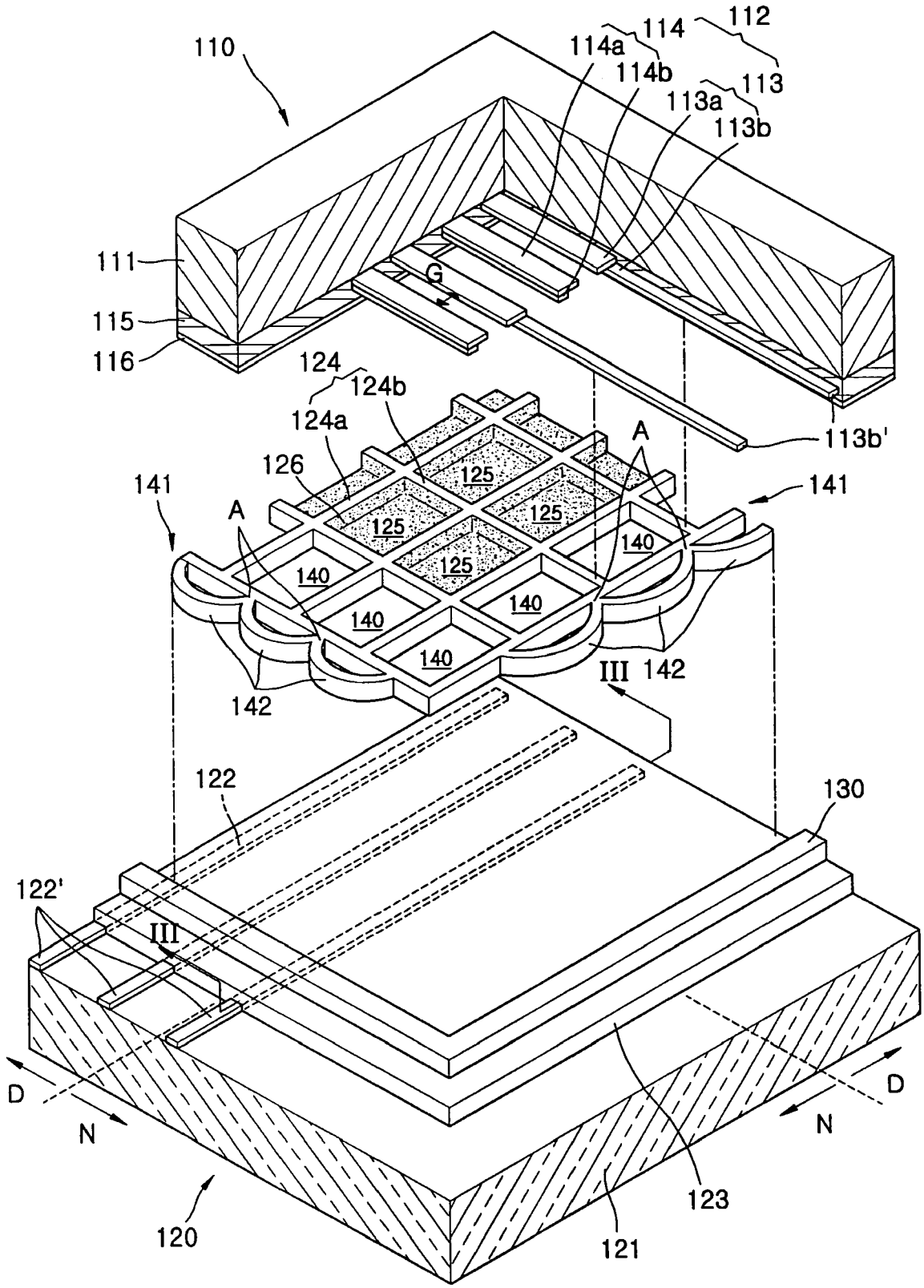
FIG. 2 is an exploded perspective view of a part of the plasma display panel of FIG. 1.
Figure 3:
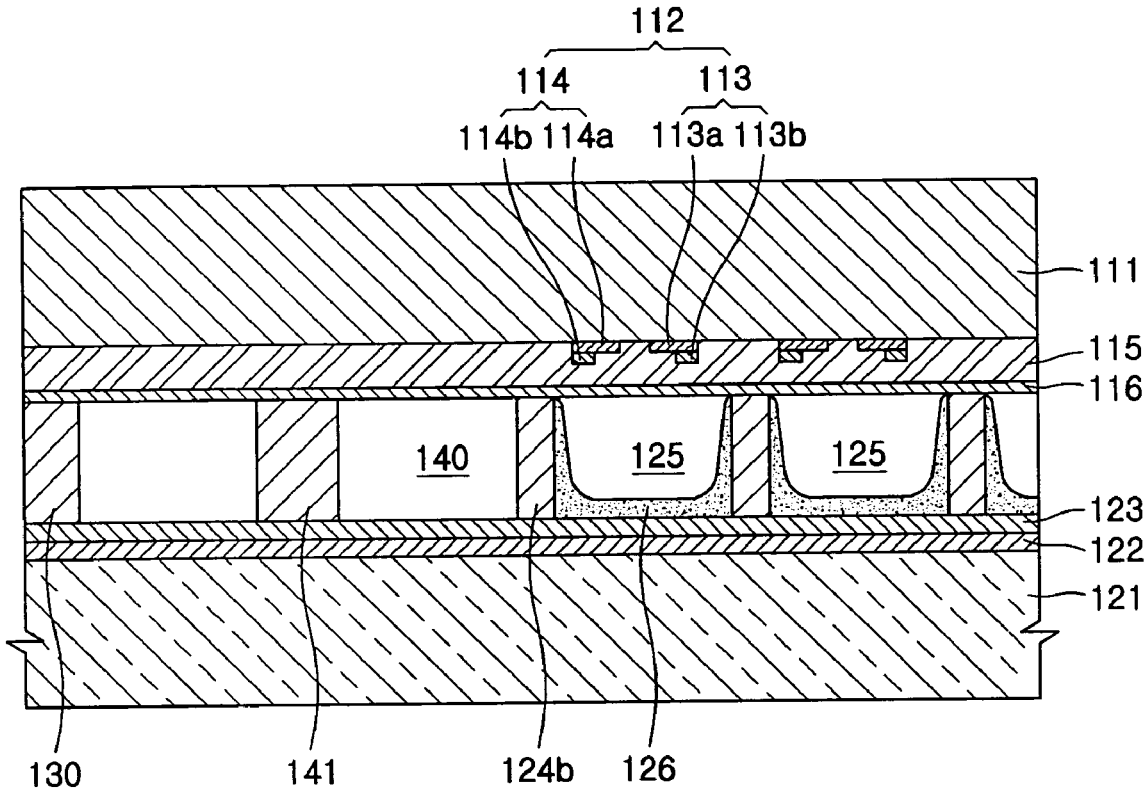
FIG. 3 is a cross-sectional view of the plasma display panel taken along line III-III of FIG. 2.

The display area (D) and the non-display area (N) will be described with reference to FIGS. 2 thru 4. FIG. 2 is an exploded perspective view of a part of the plasma display panel of FIG. 1, and more particularly an exploded perspective view of some parts of the display area (D) and the non-display area (N) in the plasma display panel of FIG. 1; FIG. 3 is a cross-sectional view of the plasma display panel taken along line III-III of FIG. 2; and FIG. 4 is a plan view of the electrodes of FIG. 2 disposed with respect to dummy barrier ribs.

Figure 4:
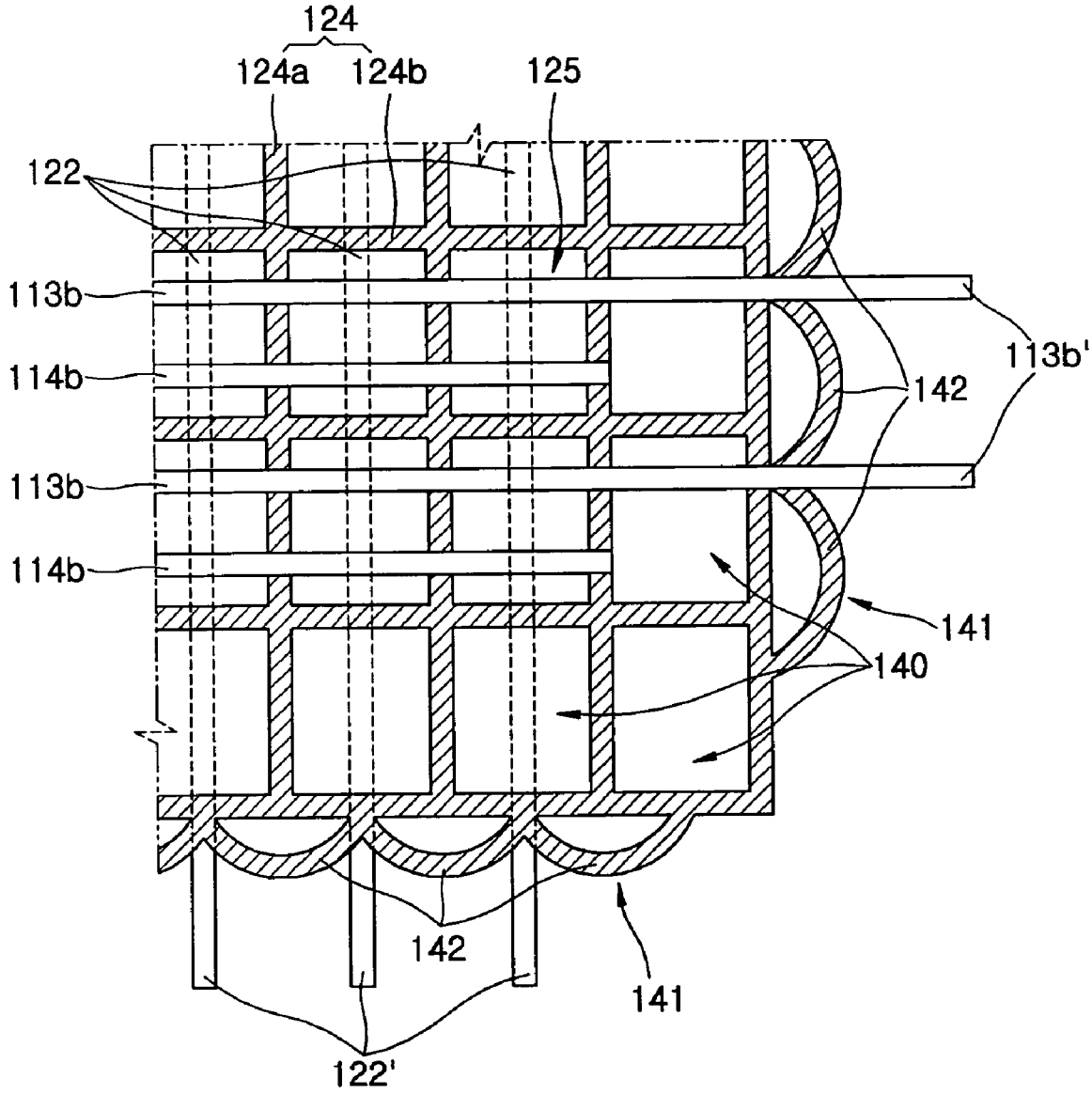
FIG. 4 is a plan view of electrodes of FIG. 2 disposed with respect to dummy barrier ribs.

Referring to FIGS. 2 thru 4, the upper substrate 111 is formed of a transparent glass material through which light can pass, and the lower substrate 121 is disposed so as to face the upper substrate 111.

A plurality of pairs of sustain electrodes 112 that extend along discharge cells 125 arranged in a predetermined direction are disposed under the upper substrate 111, and address electrodes 122 extending so as to cross the sustain electrode pairs 112 are disposed over the lower substrate 121. The address electrodes 122 are disposed in a stripe pattern on an upper surface of the lower substrate 121, and at least one of the address electrodes 122 is disposed at each discharge cell 125. The address electrodes 122 are covered by and embedded in a lower dielectric layer 123 formed on the lower substrate 121.

In addition, the sustain electrode pairs 112 are formed on a lower surface of the upper substrate 111, and each pair includes a common electrode 113 and a scan electrode 114. The common electrode 113 and the scan electrode 114 form a discharge gap (G) therebetween, and are commonly disposed at each discharge cell 125. The scan electrode 114 generates an address discharge with the address electrode 122, and the common electrode 113 generates a sustain discharge with the scan electrode 114.

The common electrode 113 includes a common transparent electrode 113*a* and a common bus electrode 113*b* connected to the common transparent electrode 113*a*. The scan electrode 114 includes a scan transparent electrode 114*a* and a scan bus electrode 114*b* connected to the scan transparent electrode 114*a*.

The common and scan transparent electrodes 113*a* and 114*a* are formed of a transparent material, such as indium tin oxide (ITO), in order to pass visible light generated during the discharge through themselves. The common and scan bus electrodes 113*b* and 114*b*, connected to the common and scan transparent electrodes 113*a* and 114*a*, apply voltages to the common and scan transparent electrodes 113*a* and 114*a*. It is desirable that the common and scan bus electrodes 113*b* and 114*b* be formed of metal having a high conductivity, such as Cu or Ag, in order to improve the electric resistances of the common and scan transparent electrodes 113*a* and 114*a* that are formed of ITO having a relatively low conductivity. In addition, the common and scan bus electrodes 113*b* and 114*b* have narrower widths than those of the common and scan transparent electrodes 113*a* and 114*a*, and extend in directions perpendicular to the directions of the address electrodes 122.

The sustain electrode pairs 112 are covered by and embedded in an upper dielectric layer 115 formed on the lower surface of the upper substrate 111. In addition, the upper dielectric layer 115 may be covered by a protective layer 116 formed of MgO. The protective layer 116 prevents charged particles from directly colliding with the upper dielectric layer 115 and causing damage to the upper dielectric layer 115, and protection layer 116 emits secondary electrons when charged particles collide with the protective layer 116, thereby improving discharge efficiency.

Main barrier ribs 124 are formed in a predetermined pattern between the upper and lower substrates 111 and 121, that is, between the protective layer 116 and the lower dielectric layer 123. The main barrier ribs 124 define a plurality of discharge cells 125, and prevent crosstalk from being generated between neighboring discharge cells 125. A discharge gas is inserted in the discharge cells 125 defined by the main barrier ribs 124, and Penning mixed gas can be used as the discharge gas.

As shown in the drawings, the main barrier ribs 124 defining the discharge cells 125 include longitudinal main barrier ribs 124*a* separated by predetermined distances from each other, and transverse main barrier ribs 124*b* extending from sides of the longitudinal main barrier ribs 124*a* in directions perpendicular to the longitudinal main barrier ribs 124*a*, and having substantially the same heights as those of the longitudinal main barrier ribs 124*a*. The longitudinal main barrier ribs 124*a* are disposed between the address electrode 122 and in parallel with address electrodes 122, and the transverse main barrier ribs 124*b* are disposed between the sustain electrode pairs 112 and in parallel with the sustain electrode pairs 112. In addition, the transverse main barrier ribs 124*b* are disposed at both end portions of the longitudinal main barrier ribs 124*a* so as to form closures between the ends of the longitudinal main barrier ribs 124*a*.

Since the longitudinal main barrier ribs 124*a* and the transverse main barrier ribs 124*b* are formed in a matrix pattern, the respective discharge cells 125 are defined by four closed sides. Among the discharge cells 125, the discharge cells 125 arranged at least in a row along edges of the panel 100 can function as dummy cells 140 for obtaining stable image quality of the panel 100. Only one of the sustain electrode pairs 112 and the address electrodes 122 can be disposed at each of the dummy cells 140, and accordingly, the dummy cells 140 are included in the non-display area (N) wherein discharge does not occur.

A phosphor layer 126 is disposed in the discharge cells 125 defined by the main barrier ribs 124. That is, a fluorescent material is applied to inner surfaces of the main barrier ribs 124 and to upper surface of the lower dielectric layer 123 defined by the main barrier ribs 124 so as to form the phosphor layer 126.

The fluorescent material can be classified as red, green and blue fluorescent materials representing red, green and blue colors, respectively, and accordingly, the phosphor layer 126 can be also classified into red, green and blue phosphor layers. In addition, the discharge cells 125 wherein the red, green and blue phosphor layers are disposed become red, green and blue discharge cells, respectively, and three neighboring red, green and blue discharge cells form a unit pixel.

Dummy barrier ribs 141 are, according to the present invention, formed on the outermost portions of the main barrier ribs 124.

Further referring to FIGS. 2 thru 4, the dummy barrier ribs 141 are arranged along the outermost portion of the main barrier ribs 124, and each of the dummy barrier ribs 141 includes a plurality of dummy units 142, end portions of which are connected to each other. The dummy units 142 are curved toward the outer portion of the panel 100 with predetermined curvatures, but they can be formed variously so long as they protrude toward the outer portion of the panel 100. Since the dummy barrier ribs 141 have the above structure, connection portions (A) between the dummy units 142 are relatively less contracted than the other portions of the dummy units 142 after performing a baking process with respect to the dummy barrier ribs 141, and thus, the height of connection portions (A) can be lowered.

In addition, the connection portions (A) between the dummy units 142 formed on the dummy barrier ribs 141 can be connected to the main barrier ribs 124, and accordingly, closed spaces can be formed between the dummy barrier ribs 141 and the main barrier ribs 124. Therefore, it is desirable that the dummy barrier ribs 141 and the main barrier ribs 124 be formed integrally with respect to each other. However, the shapes of the dummy barrier ribs 141 are not limited to the above, and the dummy barrier ribs 141 can be separated by predetermined distances from the main barrier ribs 124.

Terminal units of the sustain electrode pairs 112 and terminal units 122' of the address electrodes 122 are drawn to the non-display area (N) on upper and lower portions of the dummy barrier ribs 141 disposed at the outermost portion of the main barrier ribs 124. The terminal units disposed at the non-display area (N) are electrically connected to driving units (not shown).

Further referring to the drawings, the terminal units 113*b*' included in the common electrodes 113 that form the sustain electrode pairs 112, that is, the terminal units 113*b*' (FIG. 4) disposed at the common bus electrodes 113*b* are drawn to the non-display area (N) through the dummy barrier ribs 141 disposed in correspondence to the terminal units 113*b*'. In this regard, the connection portions (A) between the dummy units 142 of the dummy barrier ribs 141 overlap with the terminal units 113*b*' of the common bus electrodes 113*b*, which are drawn to the non-display area (N) through the dummy barrier ribs 141.

Since the terminal units 113*b*' of the common bus electrodes 113*b* are drawn to the non-display area (N) through the connection portions (A) between the dummy units 142, which are relatively lower than the other portion, the probability of detachment between the dummy barrier ribs 141 and the upper dielectric layer 115 can be minimized, and vibration noise can be reduced. Since the common bus electrodes 113*b* are covered by the upper dielectric layer 115, the thickness of the upper dielectric layer 115 at the portions where the common bus electrodes 113*b* are disposed is thicker than that of the upper dielectric layer 115 at the other portions where the common bus electrodes 113*b* are not disposed. Therefore, the thicker portions of the upper dielectric layer 115 correspond to the connection portions (A) between the dummy units 142, which are relatively lower than the other portions, and thus, the gap between connection portions (A) and the thicker portions of the upper dielectric layer 115 can be reduced, and the probability of detachment between the dummy barrier ribs 141 and the upper dielectric layer 115 can be reduced.

In addition, the structure for drawing the common electrodes 113 through the dummy barrier ribs 141 can also be applied to the scan electrodes 114 forming the sustain electrode pairs 112 with the common electrodes 113. That is, terminal units of the scan electrodes 114 can extend toward the opposite direction of terminal units of the common electrodes 113, and can be drawn to the non-display area (N), and the dummy barrier ribs 141 can be disposed so as to correspond to the terminal units of the scan electrodes 114. In this regard, the connection portions (A) between the dummy units 142 of the dummy barrier ribs 141 overlap with the terminal units of the scan electrodes 114, that is, the terminal units of the scan bus electrodes 114*b*, which are drawn to the non-display area (N) through the dummy barrier ribs 141. Since the terminal units of the scan bus electrodes 114*b* are drawn to the non-display area through the connection portions (A) between the dummy units 142, which are relatively lower than the other portions, the probability of detachment between the dummy barrier ribs 141 and the upper dielectric layer 115 can be minimized.

As in the case of the sustain electrode pairs 112 that are drawn to the non-display area (N) through the dummy barrier ribs 141, terminal units 122' of the address electrodes 122 are drawn to the non-display area (N) through the dummy barrier ribs 141 corresponding to the address electrodes 122. In addition, the connection portions (A) between the dummy units 142 of the dummy barrier ribs 141 overlap with the terminal units 122' of the address electrodes 122, which are drawn to the non-display area (N) through the dummy barrier ribs 141.

Since the terminal units 122' of the address electrodes 122 are drawn to the non-display area (N) through the connection portions (A) that are relatively lower than other portions between the dummy units 142, the probability of detachment between the dummy barrier ribs 141 and the upper dielectric layer 115 can be minimized, and vibration noise can be reduced. Since the address electrodes 122 are covered by the lower dielectric layer 123, the lower dielectric layer 123 at the portions where the address electrodes 122 are disposed is thicker than the lower dielectric layer 123 at the other portions where the address electrodes 122 are not disposed. Therefore, the thicker portions of the lower dielectric layer 123 correspond to the connection portions (A) between the dummy units 142, which are relatively lower than the other portions, and thus, the connection portions (A) between the dummy units 142 are pushed against the thicker portions of the upper dielectric layer 115, and the probability of detachment between the dummy barrier ribs 141 and the upper dielectric layer 115 is reduced.

In addition, it is desirable that the dummy barrier ribs 141 having the above structure be disposed apart by predetermined distances from the sealing member 130 that couples the upper and lower panels 110 and 120, and thus air exhaustion can be performed sufficiently through the space between the dummy barrier ribs 141 and the sealing member 130. Accordingly, increase in discharge voltage due to impurities remaining in the panel 100 or mis-discharge can be prevented, and the discharge efficiency is not lowered.

As described above, the connection portions (A) between the dummy units 142 of the dummy barrier ribs 141 are disposed to overlap with the terminal units of the electrodes, and the probability of detachment between the dielectric layer 115 and the dummy barrier ribs 141 is minimized. In addition, vibration noise caused by the detachment phenomenon can be reduced.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

an upper substrate;

an upper dielectric layer formed on a lower surface of the upper substrate;

sustain electrodes disposed in the upper dielectric layer;

a lower substrate facing the upper substrate;

a lower dielectric layer formed on an upper surface of the lower substrate;

address electrodes formed in the lower dielectric layer so as to cross the sustain electrodes;

main barrier ribs disposed on the lower dielectric layer so as to define discharge cells corresponding to regions where the sustain electrodes and the address electrodes cross each other;

a phosphor layer formed in the discharge cells; and dummy barrier ribs disposed at an outermost portion of the main barrier ribs, and including respective dummy units which protrude from the main barrier ribs toward an outer portion of the plasma display panel, and which are connected to each other;

wherein connection portions between the dummy units are disposed so as to overlap with at least one of terminal units of the sustain electrodes and terminal units of the address electrodes.

2. The plasma display panel of claim 1, wherein the connection portions between the dummy units are connected to the main barrier ribs.

3. The plasma display panel of claim 2, wherein the dummy barrier ribs and the main barrier ribs are formed integrally with each other.

4. The plasma display panel of claim 1, wherein the dummy barrier ribs and the main barrier ribs are formed integrally with each other.

5. The plasma display panel of claim 1, wherein the dummy units are curved and have predetermined curvatures.

6. The plasma display panel of claim 1, wherein the main barrier ribs define the discharge cells in matrix forms.

7. The plasma display panel of claim 6, wherein the discharge cells are arranged in a row at least at the outermost portion of the main barrier ribs among discharge cells corresponding to the dummy units.

8. The plasma display panel of claim 1, further comprising a sealing member for coupling the upper substrate and the lower substrate, and wherein the dummy barrier ribs are separated from the sealing member.

9. The plasma display panel of claim 1, wherein a pair of the sustain electrodes is disposed at each respective discharge cell, one of the pair of the sustain electrodes functioning as a common electrode and another of the pair of the sustain electrodes functioning as a scan electrode.

10. The plasma display panel of claim 9, wherein each of the common electrodes includes a common transparent electrode and a common bus electrode connected to the common transparent electrode, and each of the scan electrodes includes a scan transparent electrode forming a discharge gap with the common transparent electrode and a scan bus electrode connected to the scan transparent electrode.

11. The plasma display panel of claim 10, wherein terminal units of the common bus electrodes and terminal units of the scan bus electrodes are disposed so as to overlap with the connection portions between the dummy units.

12. The plasma display panel of claim 11, wherein the terminal units of the common bus electrodes and the terminal units of the scan bus electrodes extend in respective directions which are opposite to each other.

13. The plasma display panel of claim 10, wherein terminal units of the common bus electrodes and terminal units of the scan bus electrodes extend in respective directions which are opposite to each other.

14. The plasma display panel of claim 1, further comprising a protective layer formed on a lower surface of the upper dielectric layer.

* * * * *